US005551342A

United States Patent [19]

Fuchs et al.

[11] Patent Number: 5,551,342

[45] Date of Patent: Sep. 3, 1996

[54] METHOD FOR CONTROLLING THE INK GUIDANCE IN A PRINTING MACHINE

[75] Inventors: Thomas Fuchs, Muhlheim; Johannes Slotta, Gelnhausen; Dieter Wagner, Heidelberg, all of Germany

[73] Assignee: MAN Roland Druckmaschinen AG, Germany

[21] Appl. No.: 361,596

[22] Filed: Dec. 22, 1994

[30] Foreign Application Priority Data

Dec. 22, 1993 [DE] Germany ..... 43 43 905

[51] Int. Cl.[6] ..... B41F 31/05

[52] U.S. Cl. ..... 101/484; 101/485; 101/365

[58] Field of Search ..... 101/365, DIG. 45, 101/DIG. 47, 148, 350, 349, 483, 211, 484, 485, 486; 364/526; 358/515; 250/559.06, 559.01, 559.04

[56] References Cited

U.S. PATENT DOCUMENTS 4,649,502 3/1987 Keller et al. .

5,224,421 7/1993 Doherty .

FOREIGN PATENT DOCUMENTS 0143744 10/1984 European Pat. Off. .

*Primary Examiner*—J. Reed Fisher

*Attorney, Agent, or Firm*—Leydig, Voit & Mayer, Ltd.

[57] ABSTRACT

A method for controlling the ink guidance of a printing machine, especially a sheet-fed offset printing machine. Ink-density spectra are recorded by means of a spectral photometer at a plurality of image points of the original and of the printed copy and the differential ink-density spectra are determined from these values. These differential ink-density spectra are then represented as a linear combination of the individual ink-density spectra of the inks participating in the composite printing. Regulating commands for the ink-guide members of the printing machine are thereupon derived from the proportionality factors of this linear combination.

5 Claims, 2 Drawing Sheets

METHOD FOR CONTROLLING THE INK GUIDANCE IN A PRINTING MACHINE

BACKGROUND OF THE INVENTION

1. Field of the Invention

The present invention relates to a method for controlling the ink guidance in a printing machine, and more particularly, to a method for controlling the color ink guidance in a sheet fed offset printing machine.

2. Discussion of the Prior Art

The visual color effect of offset printing products is obtained in a known manner by an interaction of subtractive and additive color mixing. Individual half-tone dots of the various printing inks are printed in differing size both next to one another, and one above the other so as to overlap to a greater or lesser extent. At the same time, the printing inks used have a glazing effect, that is to say the effect corresponds to a filter resting on the white printing material. The coloring direction of the composite printing of the half-tone dots is determined both by the layer thickness of the applied printing ink and by the size of the half-tone dots (geometrical surface covering). Thus, by adjusting the ink-guide members in the individual printing units, the color location of a printing-image point can be varied. Typically, in color printing, three colored inks, cyan, magenta, and yellow, are utilized along with the standard black printing ink for printing color images.

It is well known in the printing art to record the ink application on a printing product photoelectrically by means of extra co-printed measuring elements, and to derive from this a measure of the applied ink quantity. This is usually carried out by means of densitometers, since there is a relatively simple relation between the ink-density value and the layer thickness of the ink, and therefore also the position of the ink-guide members designed, for example, as ink slides. However, a densitometric recording of the ink guidance does not provide for any numerical judgement with respect to visual color perception. Furthermore, the disadvantage of the extra co-printed measuring elements is that only the desired ink application for these measuring fields is controlled. The color effect in the printed image itself is completely ignored and is accordingly also varied only indirectly.

A method for assessing the printing quality and for regulating the ink guidance is known, for example, from EP 0,143,744 A1. The reflectances in four spectral regions are measured with one or more measuring heads by means of image elements in the subject. For the three colored inks, the spectral regions are selected in such a way that the conventional ink-density values are obtained. For the black printing ink, the spectral reflectance in the infrared region is determined. The corresponding surface coverings are determined (unmasked) from these reflectances or ink-density values by using the Neugebauer equations. This is carried out at the same image points of copies printed on the machine and also on a desired original. Regulating commands for the ink guidance of the printing machine are then derived from a desired/actual comparison of the surface coverings.

DE 4,311,132 A1 discloses a method for ink regulation/control in a printing machine. The method is characterized in that the density spectra of specimen prints of the individual printing inks participating in the composite printing and having a predetermined surface covering, and of the white paper are recorded and stored, the density spectra of a measuring point of the original and of a measuring point of the printed copy are recorded, and in that these measured density spectra of the original and of the printed copy are each represented as a linear combination of the factor-weighted density spectra of the individual printing inks and of the white paper with the aim of representing the density spectra of the composite printing of the measuring point of the original and printed copy in the best possible way in each case by means of this linear combination. The ink feed is changed as a function of the difference between the individual factors of the respective linear combination (original/printed copy) which are interpreted as degrees of surface covering.

A disadvantage of this known method is that the factors in the formulation of the linear combination for representing the entire density spectrum (composite printing) are formulated from the density spectra of the individual inks as degrees of surface covering. Where the factors are concerned, a formulation of this kind presents problems in the case of high degrees of surface covering of a particular ink at the image point and fails completely when one or more inks are printed in full tone. The reason lies, in a way which is simple to see, in the fact that, for example, if an ink of the original is printed as a full-tone surface, the corresponding ink in the printed copy can likewise be printed only as a full tone and not to a greater extent than this. It is therefore impossible to regulate inks in the full-tone range.

SUMMARY OF THE INVENTION

The present invention is directed to a method for controlling the ink guidance in an offset printing machine. The method comprises the steps of recording the ink-density spectra of at least one image point in an original and a printed copy, calculating a differential ink-density spectrum from the ink-density spectra of the at least one image point in the original and printed copy and representing the ink-density spectra as a linear combination of the ink-density spectra of the individual printing inks participating in the composite printing, and regulating ink-guide members of the printing machine in accordance with a set of proportionality factors determined from the calculation of the differential ink-density spectrum. The present invention provides for the greatest possible identity between the ink-density spectra of the at least one image point of the original and the printed copy.

According to the methodology of the present invention, provision is made for determining the reflectance values at corresponding image points of the original and printed copy by means of a multiplicity of spectral regions, and for converting these values into ink-density values in a known way by taking the logarithms of these values. The ink-density spectra are thus determined at the image points of the original and printed copy. The ink-density spectrum of an image point of the original represents the so-called desired ink-density spectrum, and the spectrum of an image point in the printed copy represents the actual ink-density spectrum.

The differential ink-density spectrum is then determined for each image point by differentiating the desired and the actual ink-density spectrum. The differential ink-density spectrum of each image point is then represented in the form of a linear combination of the ink-density spectra of the printing inks which participate in the composite printing of the image point. The proportionality factors of this linear combination, that is to say the factors by which the corresponding ink-density spectra of the individual inks are to be multiplied, then give a direct and reliable measure of the amount by which the ink guidance of the respective printing ink is to be varied.

The ink-density spectra of the individual inks on the printed copy are determined by means of the measuring fields co-printed on the printed copy or by means of measuring fields located on specimen prints previously made. For this purpose, in the first-mentioned procedure, a print-checking strip is co-printed next to the subject in a known way and which contains a measuring field of the full tone in each ink-metering zone for each printed ink. The print-checking strip extends, in particular, in a direction parallel to the sheet edge of the print start.

According to the methodology of the present invention, provision is made, when the differential ink-density spectrum of an image point is represented, for those inks not participating in the composite printing of this same image point to remain unused. The associated proportionality factors are therefore set equal to zero. Advantageously, provision may be made, here, for inks, of which the proportion of printing surfaces below a specific percentage for example, less than 10%, likewise to remain unused in the linear-combination representation of the differential ink-density spectrum of the particular image point. This preliminary information over the proportion of printing surface of a printing ink of a specific image point may be determined either directly from the preliminary stage, film or electronic preliminary stage, or from the offset printing plate. It is also possible, in principle, to determine the proportion of printing surface of a specific printing ink by means of a colorimetric analysis of the corresponding image point. It is then possible, at the same time, to utilize the fact that, in a specific set of printing inks and a specific type of printing material, specific color locations exclude the participation of one or more printing inks. It is also possible, in the case of specific regions in the colorimetric ink space, to accept the proportion of printing surface of one or more printing inks below a specific percentage of printing surface. In principle, a visual analysis using for example, a measuring glass or video analysis of the image points provided are also possible.

The original, in relation to which the image points of the printed copies are to be adjusted in terms of their color appearance or spectral appearance, may be an OK sheet, a proof copy or a proof. In the method according to the present invention, it is not important that the original was produced with the same printing inks and the same type of printing material, although this is considered especially advantageous. The reason for this is that, in the final analysis, the spectral differences, i.e., the differential ink-density spectrum, between the original and printed copy are minimized, and this takes place in that the corresponding proportionality factors in the representation of the linear combination are to be determined in such a way that the printing inks used during the printing of the printed copies or their ink-density spectra obtained by means of full tones are intensified or attenuated so that the difference in the ink-density spectrum becomes minimal.

A preferred development of the method according to the present invention provides for carrying out a weighting of the ink-density spectra of the printing inks participating in the composite printing of an image point in terms of their proportion of printing surface. Thus, provision may be made, for example, when cyan represents a surface covering of only 5 to 10%, for the ink-density spectrum of the cyan, as used in the printing of the printed copies to remain completely unused in the linear-combination representation of the differential ink-density spectrum. Within such a small proportion of printing surface, therefore, a zero weighting of the corresponding ink-density spectrum takes place. Accordingly, the degrees of surface covering of the printing inks participating in the composite printing of an image point of the original may then be assigned specific weighting factors in the lower, middle and upper tone-value range. The corresponding assignment of the weighting factors is determined empirically by means of printing tests. Here too, the electronic preliminary printing stage, the film, the printing plate, a visual, or video analysis of the corresponding image points may be utilized for determining the surface covering.

In order to obtain information on the degree of surface covering of a printing ink which participates in the composite printing of an image point, either the image point of the original or the image point of the printed copy may be employed.

With respect to the black printing ink, an especially advantageous and simple way of determining the surface covering is possible. For this purpose, the infrared ink density is determined in a region of the infrared range of the spectrum. A conclusion as to the surface covering of the black printing ink may then be drawn in a known manner from the measured infrared ink density by means of an empirical relation. In particular, it may thereby be established whether the black printing ink participates at all in the composite printing of this particular image point.

The method according to the present invention is especially advantageous when, in particular, the image points of the originals are measured not only in the spectral region of visible light, but furthermore also in a region of the infrared spectrum and the infrared ink density is determined from the measured value in the infrared spectrum. As explained above, the differential ink-density spectrum is then determined for each image point. From a knowledge of the infrared ink density, this differential ink-density spectrum may then be reduced by the amount of the influence of the black printing ink according to a relation which may be determined empirically. A differential ink-density spectrum of the image point which has arisen as a result of the composite printing of only the colored inks is thus obtained. The representation of the differential ink-density spectrum reduced in this way, without the black-fraction, then likewise takes place in the form of a linear combination by means of the ink-density spectra of the printing inks participating in the production of the printed copies.

DESCRIPTION OF THE PREFERRED EMBODIMENTS

The present invention provides for a method of controlling the ink-guidance in a printing machine. The method which may be implemented utilizing a microprocessor, includes the calculation of the differential ink-density spectrum by calculating the difference between the actual and desired ink-density spectra, and setting this difference equal to a linear combination of the ink density spectra of the printing inks which are used in the composite printing of the image. The linear combination also includes weighting factors indicative of surface coverage and proportionality factors which provides for the control of the ink-guidance members as is explained in detail below.

A brief explanation of an exemplary embodiment of the invention, in conjunction with the corresponding mathematical formulations, is given below. For purposes of this explanation it is assumed that printed copies in the form of sheets are to be produced on a sheet-fed offset printing machine and a print-checking strip with individual measuring fields of the inks participating in the printing are co-printed on these sheets. This print-checking strip runs in a direction parallel to the edge of the print start. The original is a sheet which is produced on the same machine and which has been judged as optimum in terms of its color appearance, i.e., an OK sheet.

A specific number of image points, for example one or more in each ink-metering zone, is fixed in the subject of the printing sheet. The image points are, in particular, parts of the subject which are to be considered particularly important. The selection of the image points to be taken into account is advantageously carried out on the printing sheet of the original.

Figure 1:
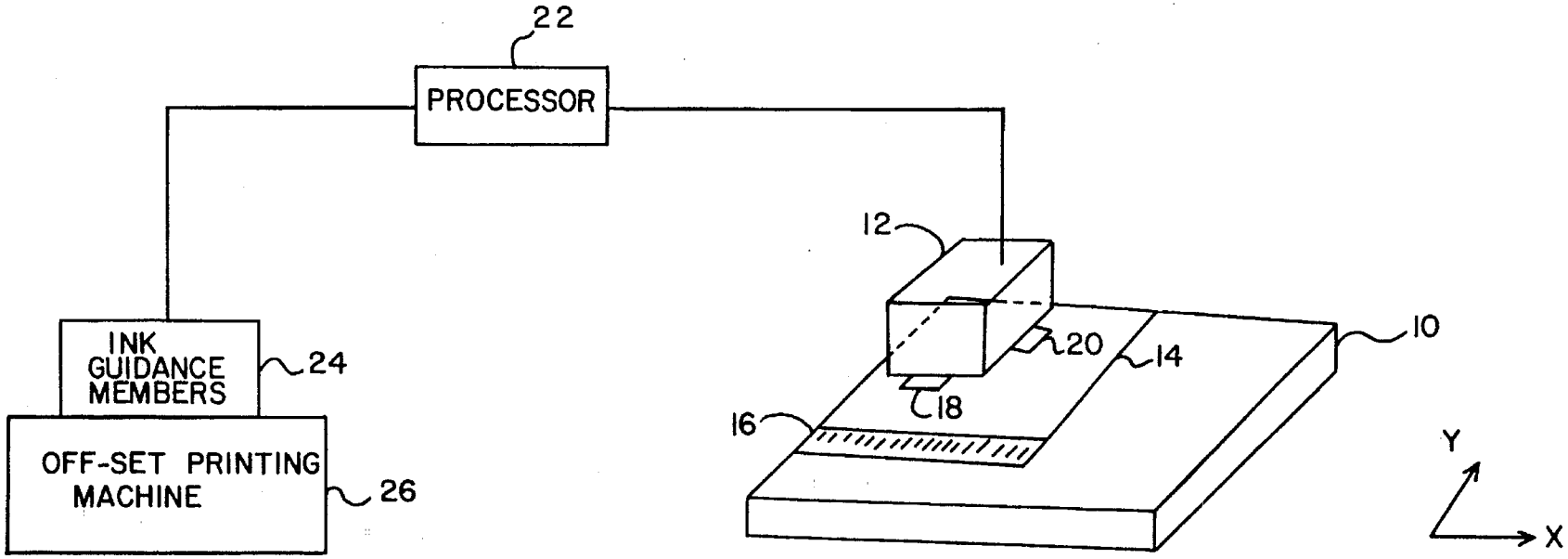
FIG. 1 is a diagrammatic representation of an X-Y coordinate measuring table and a spectral photometer for the determination and measurement of the image points in accordance with the present invention.

To explain the exemplary embodiment of the invention, reference is made to FIG. 1 which illustrates a means for determining and measuring a predetermined number of image points. As illustrated in FIG. 1, the determination and measurement of the image points both on the original and on the printed copies take place on an X-Y-coordinate measuring table 10 which has a spectral photometer 12 movable in the entire plane of the printing sheet 14. Spectral photometers are devices well known in the art for the measurement of reflectance values in the various spectral ranges. The print-checking strip 16 is positioned on the printing sheet 14 and as stated above, runs in a direction parallel to the edges of the print start. A spectral photometer 12 of this type may then be moved automatically by corresponding positioning drives 18 and 20 to the positions provided for the selected image points. The positioning drives 18 and 20 may comprise any suitable devices for moving the spectral photometer 12 in the x-y plane. Devices such as these are well known in the art and may be easily configured to receive commands from microprocessors. The positions of the selected image points may be stored, for example, in a processor 22 and associated memory, and thereupon approached automatically by program flow. After each approach of an image point, the determination of the spectral reflectance and, in a processor 22, conversion into the ink-density spectrum then may take place. The conversion of the reflectance values into the ink-density spectrum is described in detail below. The storage of the positions of the selected image points is carried out during a measuring run which is to be executed once. The processor 22 issues commands to the positioning drives 18 and 20 to move the spectral photometer 12. The processor 22 also issues commands to the ink guidance members 24 of the offset printing machine 26 as is explained subsequently. Essentially, the processor 22 implements the various functional processes, makes the necessary calculations, and generates control signals which regulate the ink guidance members 24 of the offset printing machine 26 in accordance with a predetermined program loaded in the memory associated with the processor 22.

Figure 2:
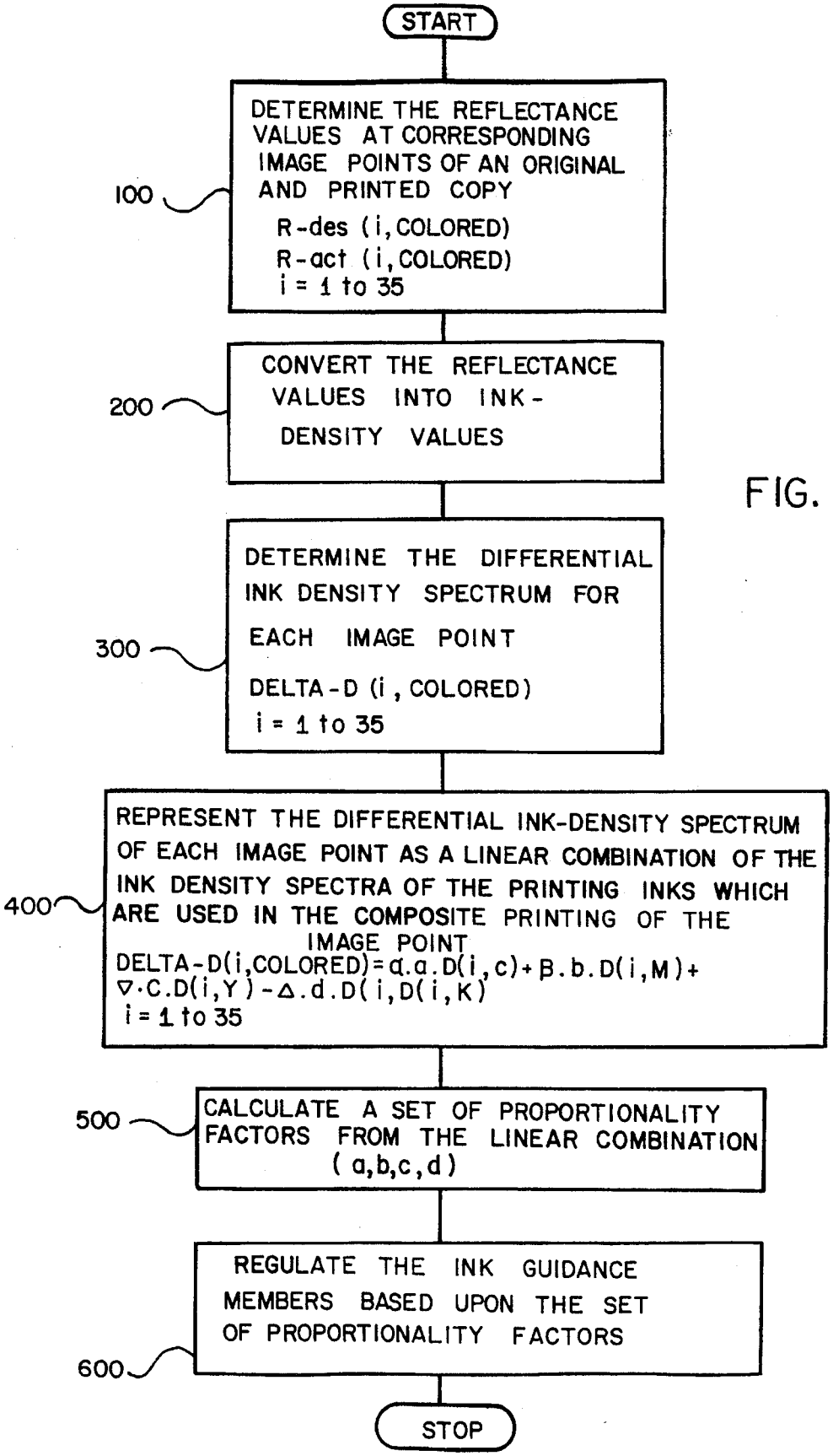
FIG. 2 is a flow chart of the method for controlling the ink guidance in a printing machine in accordance with the present invention.

In the sheet serving as an original, the image points provided have been selected and their positions stored by means of the measuring instrument described above, i.e., the spectral photometer 12. Although the process is the same for all image points, the detailed explanation of the exemplary embodiment of the process of the present invention describes the course of the process at a single image point both in the original and in the sheet of the printed copy for ease of explanation. FIG. 2 is a flow chart of the method for controlling the ink guidance in a printing machine in accordance with the present invention. By means of the spectral photometer 12, illustrated in FIG. 1, the reflectance values R-des(i; colored), where i=1, . . . ,35, are determined at an image point of the original by means of a total of 35 supporting points of the visible spectrum. Thus, reflectance values R-des are determined at a total of 35 points and, for example, are respectively selected spectrally at a spacing of 10 nanometers (nm) from one another (350–700 nm). Element 100 in the flow chart represents the steps necessary to implement the process of determining the reflectance values.

The reflectance values R-act (i; colored), where i=1, . . . ,35, are determined by means of the spectral photometer 12 in the same wavelength range at the same image point of a first printed sheet, i.e., a printed copy. In other words, the reflectance values for a predetermined image point on both the original and a copy as determined at 35 points of the visible spectrum by the spectral photometer 12. These reflectance values are then stored in the memory associated with the processor 22 for further processing as is explained subsequently.

The respective desired and actual ink-density spectrum of the image points of the original and printed copy are then determined in a known manner by taking the logarithm to the base 10 (standard base 10 logarithm) of the individual reflectance values R-des (i; color) and R-act (i; colored). The desired and actual ink-density spectra at 35 supporting points of the visible spectrum are thus generated. The values D-des (i; colored) are obtained as the desired ink-density spectrum in the original and the values D-act (i; colored) as the actual ink-density spectrum in the printed copy, in each case with i=1, . . . ,35. Element 200 in the flow chart represents the steps necessary to implement the process of determining the ink density values from the reflectance values. The processor 22, under program control, implements the calculation of the desired and actual ink density spectra using the reflectance values determined above.

The difference is then determined for each spectral region (i=1, . . . ,35), so that the differential ink-density spectrum delta-D (i; colored) may be obtained. Element 300 in the flow chart represents the steps necessary to implement the process of calculating the difference between the ink density of the original and printed copy. The processor 22, under program control, implements the calculation of the difference between the ink-density spectra of the original and the copy.

The differential ink-density spectrum delta-D (i; color) may be determined by subtracting the actual ink-density spectra, as determined from the reflectance values obtained from the copy, from the desired ink-density spectra, as determined from the reflectance values obtained from the original. This difference may be performed by the processor 22 in a known manner.

This above-described differential ink-density spectrum delta-D (i; color) may then be represented in the form of a linear combination of the ink-density spectra of the printing inks which participate in the composite printing up the image point. The equality is given by $$\text{Delta-D(i; colored)}=\alpha.a.D(i;C)+\beta.b.D(i;M)+\nabla.c.D(i;Y)+\Delta.d.D(i;K) \quad (1)$$

Essentially, the value of the difference between the ink-density spectra of the original and the copy is set equal to the linear combination. The proportionality factors of the linear combination, i.e., the factors by which the corresponding ink-density spectra of the individual inks are to be multiplied, give a direct and reliable measure of the amount by which the ink guidance of the respective printing ink is to be varied. A complete description of the solution of the proportionality factors in the above linear combination is given subsequently. Element 400 represents the steps necessary to implement the process of representing the differential ink density spectrum as a linear combination.

Since i assumes the values 1,2 . . . ,35, there are a total of 35 equations. In the linear combination given above, D(i;C), D(i;M), D(i;Y) and D(i;K) represent the respective ink-density spectra of the values obtained on full-tone measuring fields of the sheet of the printed copy. The index C stands for the cyan printing ink, the index M for the magenta printing ink, the index Y for the yellow printing ink, and the index K for the black printing ink. Of course, other inks, in-house or special inks, may also be taken into account. As described above, the ink-density spectra of the individual inks on the printed copy are determined by means of the measuring fields co-printed on the printed copy or by means of measuring fields located on specimen prints previously made. For this purpose, a print-checking strip 16 is co-printed next to the subject in a known way and which contains a measuring field of the full tone in each ink-metering zone for each printed ink.

For this purpose, in the exemplary embodiment, in precisely that ink-metering zone in which the measured image point is located, the corresponding measuring fields of the full tones are likewise measured spectrally utilizing the spectral photometer 22 and the reflectances obtained thereby are converted into the corresponding ink-density spectra of the individual inks D(i;C), D(i;M), D(i;Y), D(i;K). Basically, the ink-density spectra of the individual inks is calculated in the same manner as the desired and actual ink-density spectra described above; namely, calculation of the reflectances and then taking the logarithm.

The weighting factors $\alpha$, $\beta$, $\nabla$, and $\Delta$, used in the linear combination for representing the differential ink-density spectrum delta-D (i;color) are selected as weighting factors in such a way that the corresponding values are between 0 and 1. The particular value selected is proportional to printing surface of the printing inks, i.e., the higher the degree of surface covering of the printing ink participating in the composite printing of the image point, the greater the number. For example, a value of 1 indicates a high degree of surface covering and 0 represents a low degree of coverage.

In accordance with an important aspect of the present invention, the weight of the ink-density spectra of the printing ink participating in the composite printing of an image point in terms of this proportion of printing surface, as mentioned above, may be determined and utilized as indicated in equation (1) to achieve a high printing quality through the more precise control of the ink-guidance members 24. Thus, provision may be made, for example, when cyan represents a surface covering of only 5 to 10%, for the ink-density spectrum of the cyan, as used in the printing of the printed copies to remain completely unused in the linear-combination representation of the differential ink-density spectrum. Within such a small proportion of printing surface, therefore, a zero weighting of the corresponding ink-density spectrum takes place. Accordingly, the degrees of surface covering of the printing inks participating in the composite printing of an image point of the original may then be assigned specific weighting factors in the lower, middle and upper tone-value range. The corresponding assignment of the weighting factors is determined empirically by means of printing tests. Here too, the electronic preliminary printing stage, the film, the printing plate, a visual, or video analysis of the corresponding image points may be utilized for determining the surface covering.

In order to obtain information on the degree of surface covering of a printing ink which participates in the composite printing of an image point, either the image point of the original or the image point of the printed copy may be employed.

In accordance with a known method of linear regression, for example, the minimization of the sum of the squares of error, the above represented equation system, which consists of a total of 35 individual equations, is solved according to the proportionality factors a, b, c, and d. The proportionality factors are solved for utilizing the minimization of the sum of the squares of error, which may be programmed into the memory associated with the processor 22. The processor 22 implements the solution technique to determine the proportionality factors and use these values, as explained below, to control the ink-guidance members 24. These factors a, b, c, and d, which are to be determined thus indicate how large the fraction of the cyan printing ink, of the magenta printing ink, of the yellow printing ink, and of the black printing ink is in the generation of the differential ink-density spectrum delta-D(i; color) in terms of the respective spectral fractions of the printing inks mentioned. The necessary changes with respect to the ink guidance (in the ink-metering zone under consideration) may then be derived from the factors a, b, c, and d, determined in this way. Clearly, for example, a positive value for the a factor means that the ink feed for the printing cyan ink in a corresponding printing unit must be increased markedly. Correspondingly, a negative value, or small amount for the a factor clearly means that the ink metering in the corresponding ink-metering zone for the cyan printing ink must be reduced somewhat. The same applies accordingly to the factors b, c, and d with respect to the interpretation in the derivation of regulating commands for the ink metering for the magenta, yellow and black printing inks. Essentially, after the proportionality coefficients are solved for using the above-described method, the processor 22 implements control over the ink-guidance members 24 in accordance with the sign of the proportionality coefficients. For example, if a is positive, the processor 22 commands the ink-guidance member for cyan to increase its output of cyan ink. Likewise, if a is negative, the processor 22 outputs a command to the cyan ink-guidance member 24 to decrease its output of cyan ink. Element 500 of the flow chart represents the steps necessary to implement the process of calculating the set of proportionality factors.

If not all the printing inks, for example, cyan, magenta, yellow and black participate in the composite printing of the image points under consideration, but, for example, only the cyan and magenta printing inks, then, according to the linear formulation given above for representing the differential ink-density spectrum delta-D(i; color), the weighting factors $\alpha$, $\beta$, $\nabla$, and $\Delta$ are each set equal to zero. This may likewise also be provided when it is evident that these inks mentioned here by way of example are represented only by a very small proportion of printing surface.

The linear formulation for representing the differential ink-density spectrum delta-D(i; color) is represented above in such a way that the black printing ink was taken into account by means of its ink-density spectrum in the visible range D (i; K). According to the invention, however, it may also be advantageous if the infrared ink density D(IR) is determined in the infrared range for the black printing ink, and if a differential ink-density spectrum delta-D(i; color-black) reduced by the amount of influence of the black printing ink is calculated from the differential ink-density spectrum delta-D(i; color) via a relation determined empirically in printing tests. In a simple example serving for illustration, this can mean that the differential ink-density spectrum delta-D(i; color) is reduced by a specific amount of ink-density units in all the spectral ranges i=1, . . . ,35. The fact that, in a first approximation, the black printing ink has a virtually constant trend in the visible range is utilized in this case.

In the above formulation for taking into account the infrared ink density D(IR) of the black printing ink, the linear representation of the reduced differential ink-density spectrum delta-D(i; color-black) = $\alpha$.a.D(i;C)+$\beta$.b.D(i;M)+$\nabla$.c.D(i;Y) is then carried out.

This differential ink-density spectrum reduced by the amount of the influence of the black printing ink is thus now represented simply from the ink-density spectra of the colored inks participating in the composite printing. According to this equation system, the determination of the proportionality factors a, b, and c then takes place once again in a known way by linear regression according to the method of least squares of error. The factors a, b, c and again represent that measure of the amount by which the respective ink guidance for the printing inks, cyan, magenta, yellow must be varied in order to achieve a predetermined spectral trend at the image point.

Element 600 of the flow chart represents the steps necessary to implement the process of regulating the ink guidance members.

Although shown and described is what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A method for controlling the ink guidance in an offset printing machine comprising the steps of:

determining desired and actual reflectance values of at least one image point in an original and a printed copy;

calculating desired and actual ink-density spectra from the desired and actual reflectance values of the at least one image point;

calculating a differential ink-density spectrum from the desired and actual in-density spectra;

equating the differential ink-density spectrum with a linear combination of the ink-density spectra of individual printing inks participating in the composite printing of the at least one image point, the linear combination including a plurality of proportionality coefficients equal in number to the number of individual printing inks participating in the composite printing of the at least one image point;

solving the linear combination for the plurality of proportionality coefficients using a regression technique; and regulating ink-guide members of the offset printing machine in accordance with the sign associated with the plurality of proportionality coefficients to increase or decrease the quantity of the particular ink participating in the composite printing of the at least one image point.

2. The method according to claim 1, further comprising the step of weighting the ink-density spectra of the individual printing inks participating in the composite printing of the at least one image point according to a proportion of printing surface of the individual printing inks.

3. The method according to claim 1, further comprising the step of determining the proportion of printing surface for a black printing ink by determining an infrared ink density.

4. The method according to claim 2, wherein the printing inks with a small proportion of printing surface remain unused in a representation of the differential ink-density spectrum.

5. The method according to claim 1, wherein the step of calculating the ink-density spectra of the individual printing inks participating in the composite printing of the at least one image point is carried out by means of full-tone measuring fields co-printed on the printed copy.

* * * * *